United States Patent [19]

Ohkochi et al.

[11] Patent Number: 4,721,159

[45] Date of Patent: Jan. 26, 1988

[54] METHOD AND DEVICE FOR CONVEYING CHEMICALS THROUGH BOREHOLE

[75] Inventors: Katsutoshi Ohkochi; Mamoru Shinozaki, both of Funabashi; Toshiyuki Ohshita, Hirakata; Masayasu Kitano, Kashihara; Seizo Kamata, Fukuoka, all of Japan

[73] Assignees: Takenaka Komuten Co., Ltd.; Sekiso Co., Ltd., both of Japan

[21] Appl. No.: 926,640

[22] Filed: Nov. 4, 1986

[30] Foreign Application Priority Data

| | | | |
|---|---|---|---|
| Jun. 10, 1986 | [JP] | Japan | 61-134180 |
| Jul. 14, 1986 | [JP] | Japan | 61-165395 |
| Jul. 15, 1986 | [JP] | Japan | 61-166081 |

[51] Int. Cl.[4] ..... E21B 33/13

[52] U.S. Cl. ..... 166/286; 166/376; 166/381; 166/117; 166/168

[58] Field of Search ..... 166/376, 286, 381, 117, 166/168, 162, 164, 902, 310, 311, 312; 206/524.6, 524.7, 524.1; 220/265, 277, 89 A, 89 B

[56] References Cited

U.S. PATENT DOCUMENTS

| | | | |
|---|---|---|---|
| 1,393,311 | 10/1921 | Pendleton | 166/286 |
| 1,609,534 | 12/1926 | Burton | 166/117 |
| 2,609,880 | 9/1952 | Dyer | 166/117 |
| 2,635,996 | 4/1953 | Rohrback et al. | 206/524.7 |
| 2,775,302 | 12/1956 | Kirkpatrick | 166/310 |
| 3,129,762 | 4/1964 | Cooper | 166/117 |
| 3,461,960 | 8/1969 | Wilson | 166/286 |
| 3,760,877 | 9/1973 | De Lajarte et al. | 166/164 |
| 4,191,254 | 3/1980 | Baughman et al. | 166/117 |
| 4,640,354 | 2/1987 | Boisson | 166/376 |

*Primary Examiner*—George A. Suchfield
*Assistant Examiner*—Bruce M. Kisliuk
*Attorney, Agent, or Firm*—Franklin D. Wolffe; Morris Fidelman

[57] ABSTRACT

A capsule for conveying chemicals through a borehole for stopping lost circulation is totally made from a thermoplastic or fragile material or has a bottom plate made from such a material. The capsule containing the chemicals is let down until it reaches the location of the lost circulation, where the capsule is either destroyed by a drilling rod or softened by the high temperature and high pressure at the location. Thus, the chemicals are diffused.

6 Claims, 22 Drawing Figures

METHOD AND DEVICE FOR CONVEYING CHEMICALS THROUGH BOREHOLE

FIELD OF THE INVENTION

The present invention relates to means for transporting a certain amount of chemicals through a borehole to a desired depth such that the chemicals are not mixed with drilling mud.

BACKGROUND OF THE INVENTION

Trial pits are formed for purposes of exploration for petroleum, geothermal energy, minerals, etc. Since these pits are as deep as 500 to 5000 m, lost circulation, or lost returns, may take place during a boring operation. If this phenomenon occurs, the drilling mud escapes into the earth through porous sidewalls, making it impossible to retain the head of the drilling mud. This may bring the porous sidewalls to destruction.

In order to plug up the gap that causes such lost circulation, chemicals are supplied to the location of the lost circulation. Originally, a supply pipe was inserted into the ground to supply the chemicals. Specifically, the chemicals are conveyed through the pipe in such a way that drilling mud is followed by the chemicals, thus forming so-called mixed-phase fluid. However, chemicals for stopping lost circulation differ from drilling mud in specific gravity, viscosity, surface tension, and other characteristics. Therefore, when chemicals which are not diffused are employed, they move downward through drilling mud. During this process, the chemicals are not mixed with the drilling mud, nor is a mass of fluid formed. Wrinkles are formed inside the pipe at the rear end. The chemicals move down the pipe while causing the wrinkles to vibrate. Therefore, a small mass is torn out of the mass of fluid at the position of one rear wrinkle. This small mass drifts within the pipe, increasing the area with which the chemicals come into contact with the drilling mud. This is undesirable for the chemicals that should be conveyed without being mixed with drilling mud. Thus, this supply is a wasteful method, and in which it is difficult to pump an almost complete mass of fluid through the pipe to the location of lost circulation.

In an attempt to avoid this problem, i.e., to convey chemicals in the form of a mass to a desired place without reducing the amount of the chemicals, capsules charged with chemicals have been used. These capsules permit chemicals to be transported without being mixed with drilling mud. One method heretofore proposed to diffuse chemicals out of the capsule that has reached the bottom of a hole is to destroy the whole capsule. Another proposed method is to open the valve mounted at the front end of the capsule.

When the former method is adopted, a destruct mechanism such as an explosive that is required to be carefully handled is needed. Further, porous sidewalls may be destroyed, depending on the destruct mechanism. In addition, the incorporation of the destruct mechanism into a capsule renders the structure complex and reduces the amount of chemicals contained in the capsule accordingly.

When the latter method is utilized, it is not assured that the valve at the front end of the capsule is opened with certainty, because of the water pressure inside the hole, the natures of the drilling mud and slime, and other factors.

SUMMARY OF THE INVENTION

It is an object of the present invention to provide a method of conveying chemicals to a desired depth within a borehole such that the porous sidewalls of the hole are not destroyed.

It is another object of the invention to provide a capsule adapted for the conveyance of chemicals as described in the previous paragraph.

The capsule according to the invention is totally made from a fragile material or a thermoplastic resin, or the bottom of the capsule is made from a fragile material or a thermoplastic resin. The capsule holding chemicals therein for stopping lost circulation is moved down a borehole to its bottom where a drilling rod exists or a high-temperature and high-pressure condition is produced. The rod has a drilling knife edge at its front end. The edge is directed toward the lowered capsule which is brought into a standstill by the rod that thus acts also as a stopper. Then, the capsule is broken by the rod, or the pressure and temperature at the bottom are sufficient high to soften and break the capsule or its bottom.

Other objects and features of the invention will appear in the course of the description thereof which follows.

DETAILED DESCRIPTION OF THE INVENTION

Figure 1:
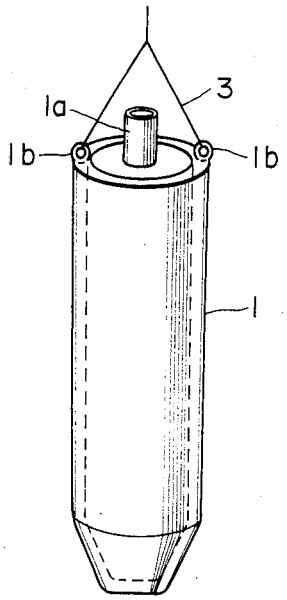
FIG. 1 is a perspective view of a capsule that is totally made from a thermoplastic resin in accordance with the invention.

Referring to FIG. 1, there is shown a capsule embodying the concept of the present invention. This capsule, indicated by reference numeral 1, is designed simply to hold chemicals, and is totally made from vinyl chloride resin, vinyl acetate resin, acrylic resin, polystyrene resin, polyethylene, cellulosic plastic, or other thermoplastic resin that softens when heated.

The material and the thickness of the capsule 1 are selected by taking account of the temperature at the depth in a drilled hole where lost circulation occurs, the time taken for the capsule to reach the depth, the time taken for the capsule to soften or melt, and other factors. Approximate temperatures at which thermoplastic resins soften or melt are as follows.

soft vinyl resin:40° to 80° C.
hard vinyl resin:60° to 80° C.
vinyl acetate resin:50° to 100° C.
acrylic resin:80° to 150° C.

Figure 7:
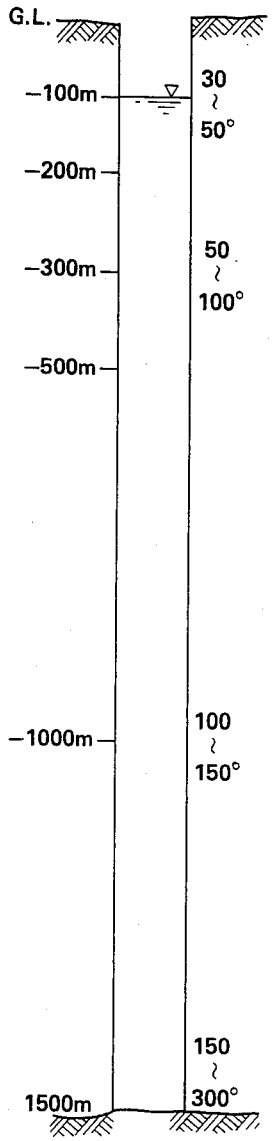
FIG. 7 is a diagram for illustrating the temperature distribution through a drilled hole.

The time taken for these resins to soften or melt ranges from about 10 to 30 minutes. The temperature distribution through a drilled hole 2 is shown in FIG. 7. The top cover of the capsule 1 shown in FIG. 1 has an opening 1*a* through which chemicals are introduced. Also, the capsule 1 has retaining portions 1*b* to which a wire 3 is anchored. Preferably, the capsule tapers forwardly as shown, because of the reasons described below. First, boreholes such as the hole 2 are relatively rarely vertical. Some boreholes are inclined at 30° or 45°. Secondly, the porous sidewalls are not flat but rough. Accordingly, in order to allow the capsule to drop smoothly, the capsule must have a self-guiding function.

Figure 2A:
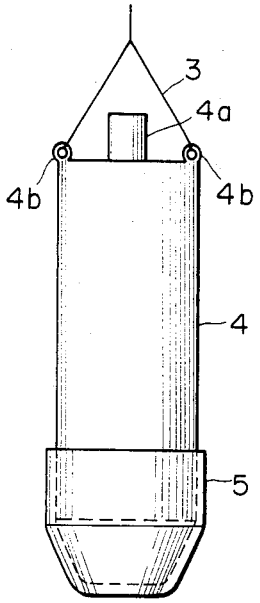
FIG. 2A is a front elevation of another capsule according to the invention, the capsule having a bottom plate made from a thermoplastic resin.
Figure 2B:
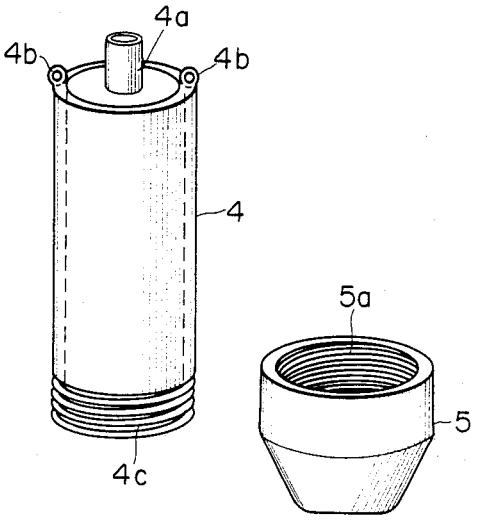
FIG. 2B is an exploded perspective view of the capsule shown in FIG. 2A.
Figure 3:
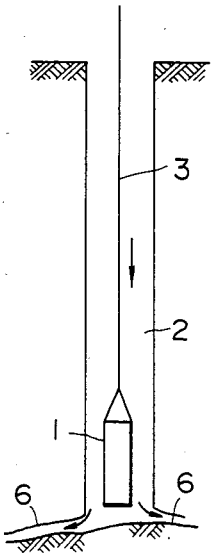
FIGS. 3 and 4 are views for showing the manner in which the capsule shown in FIG. 1 is used.

Referring next to FIGS. 2A and 2B, another capsule according to the invention is shown. The body 4 of the capsule acts simply as a container and takes the form of a cylinder. The body 4 is made of a steel tube or made from a heat-resistant, glass fiber-reinforced plastic (FRP) or the like. The top cover of the body 4 has an opening 4*a* through which chemicals are introduced. A wire 3 is anchored to retaining portions 4*b*. The body 4 is designed to be recoverable. A bottom plate 5 is fitted over the body 4. In the illustrated example, the bottom plate 5 has a tapped portion 5*a* that is screwed to a threaded portion 4*c* formed on the body 4. The bottom plate 5 is made from the same material as the aforementioned capsule 1. Thus, the bottom plate 5 softens or melts at high temperatures, and can be detached from the body 4.

Figure 4:
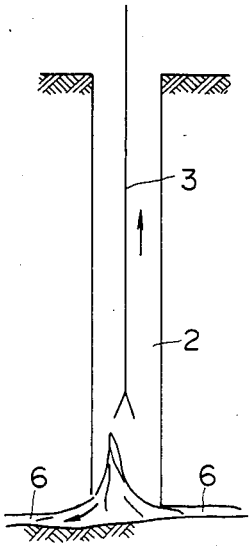

As can be understood from the description thus far made, the capsule made from a thermoplastic resin is caused to soften or melt to diffuse the chemicals contained in it in the manner described below. The capsule 1 shown in FIG. 1 is dropped to a location where lost circulation takes place, as shown in FIG. 4A. Then, the capsule 1 softens or melts, allowing the chemicals to spread. This seals up crevices 6. Subsequently, the wire 3 is pulled up, as shown in FIG. 4B.

Figure 5A:
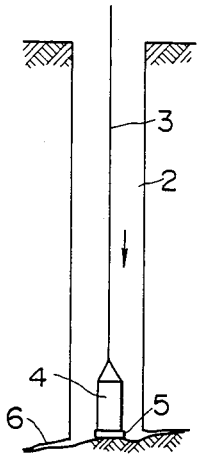
FIGS. 5A–5C are views for showing the manner in which the capsule shown in FIGS. 2A and 2B is used.
Figure 5B:
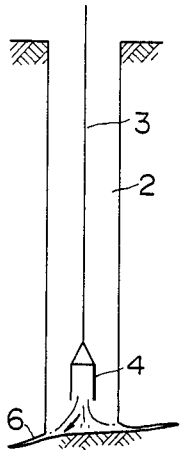
Figure 5C:
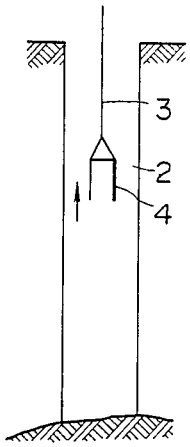

The capsule shown in FIGS. 2A and 2B is caused to fall to the location of lost circulation, as shown in FIG. 5A. The bottom plate 5 then softens or melts, so that the chemicals diffuse. As a result, crevices 6 are sealed up, as shown in FIG. 5B. Thereafter, the body 4 of the capsule is pulled up, as shown in FIG. 5C.

The novel capsules designed as mentioned above yield the following advantages.

(1) It is possible to certainly diffuse the chemicals and stop water at any desired location.

(2) The capsules seal up the fissures when softened or molten.

(3) No mechanism is needed to destroy the capsules.

(4) Since the capsules are simple in structure, it is easy to carry out the work.

(5) Stoppage of water can be effected at any desired location including intermediate positions on porous sidewalls.

(6) The capsules are economical to fabricate. Especially, the body of the capsule having the meltable bottom plate can be repeatedly used. Further, the capsule is quite cheap, because the bottom plate is cheap.

(7) Where the capsule that is totally meltable is used, after one capsule is dropped, another can be caused to move down. In this way, the work can be executed efficiently. Especially, when a large-scale lost circulation takes place, the capsule can be used to advantage.

Figure 6:
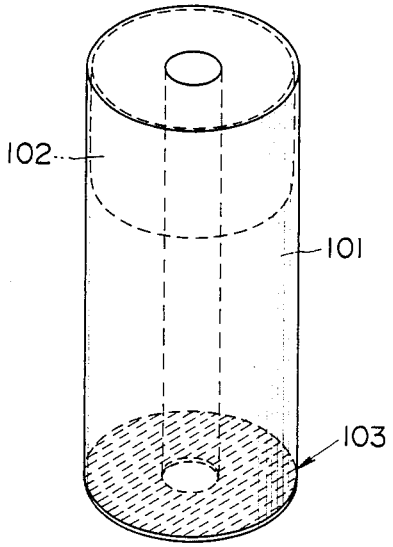
FIG. 6 is a perspective view of a further capsule according to the invention.

Referring to FIG. 6, there is shown yet another capsule according to the invention. The capsule, indicated by numeral 101, is charged with chemicals for stopping lost circulation, and is mounted on a drilling rod in such a manner that it embraces the rod. The capsule 101 is annular in shape and centrally provided with a hole in which the rod is loosely mounted. In the illustrated example, the capsule is molded entirely out of a material, and is attached to the rod at its one end. Where it is desired to mount the capsule on the rod at an intermediate location, the capsule is vertically divided into two sections which are joined together with a pin.

The capsule 101 is guided smoothly along the drilling rod through the hole until it strikes on a rig. The capsule 101 is made from a resin such as glass fiber-reinforced plastic. Magnets 102 are embedded in the capsule around the fringe at the upper end. The magnets 102 are used to attract a messenger member (described later) for recovering the capsule. The capsule has a bottom plate 103 which preferably tapers off to reduce the resistance encountered when it falls. The plate 103 is made from either a fragile material such as glass or a material that melts when heated, such as vinyl chloride resin, vinyl acetate resin, acrylic resin, polystyrene resin, polyethylene, cellulosic plastic, or other thermoplastic resin that softens when heated.

The material and the thickness of the bottom plate 103 are selected by taking account of the temperature at the depth in a drilled hole where lost circulation occurs, the time taken for the capsule to reach the depth, the time taken for the capsule to soften or melt, and other factors. Approximate temperatures at which thermoplastic resins soften or melt are as follows.

soft vinyl resin:40° to 80° C.
hard vinyl resin:60° to 80° C.
vinyl acetate resin:50° to 100° C.
acrylic resin:80° to 150° C.

The time taken for these resins to soften or melt ranges from about 10 to 30 minutes. The temperature distribution through a drilled hole is shown in FIG. 7. When the capsule 101 is to be used, chemicals are injected into it under the condition that the bottom plate 103 is not yet mounted to the body of the capsule. After the completion of the injection, the bottom plate is mounted to the body to close the capsule. It is also possible to form an opening in the top cover of the capsule for introduction of chemicals.

Figure 8:
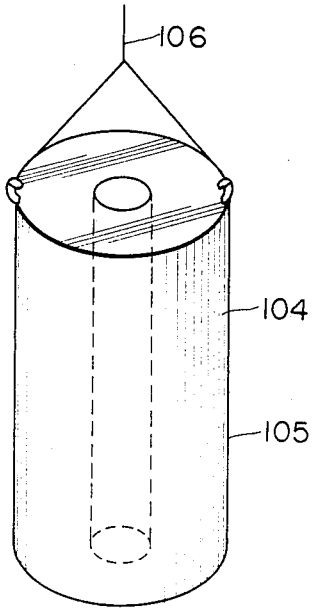
FIG. 8 is a perspective view of a weight that is used with the capsule shown in FIG. 6.

Referring next to FIG. 8, there is shown a weight 104 that is used to withdraw the capsule 101 shown in FIG. 6. The weight 104 is shaped into an annular form to permit it to be guided along a drilling rod when it falls through a drilled hole, in the same manner as the capsule 101. Again, the weight may be split into plural sections in the same manner as the capsule 101.

Magnets 105 corresponding to the magnets 102 are disposed on the weight 104 to attract the capsule 101. The weight 104 is suspended by a wire 106. The weight 104 is caused to move down a drilled hole such that it follows the capsule 101. Then, the bottom plate 103 that is not yet broken collides with a rig with certainty and breaks. The vacant capsule 101 is attracted, pulled up, and recovered for reuse.

Figures 9A, 9B, 9C, 9D:
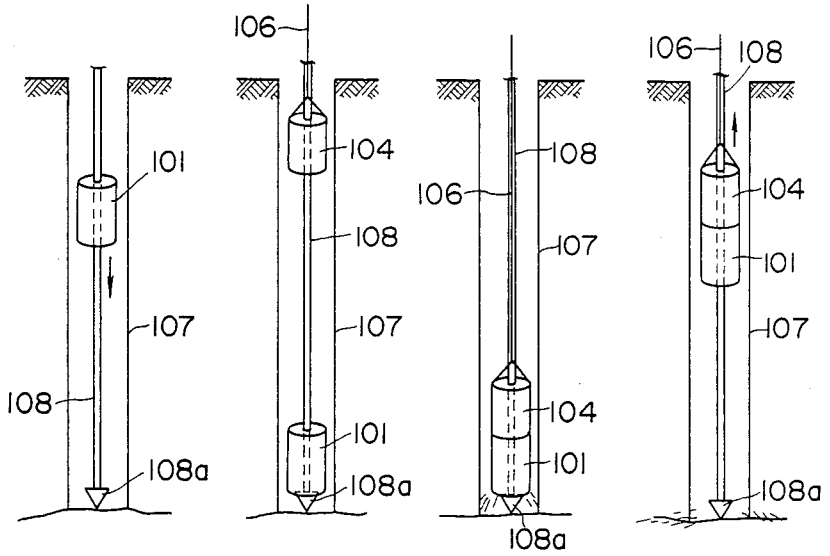
FIGS. 9A–9D are views for showing the manner in which the capsule shown in FIG. 6 and the weight shown in FIG. 8 are used.

The manner in which chemicals are conveyed with the capsule 101 is now described by referring to FIGS. 9A–9D. First, the capsule 101 is mounted to a drilling rod 108, and then is lowered, as shown in FIG. 9A. The capsule 101 collides with a rig 108*a* and comes to a halt. At this time, if the bottom plate 103 is made from a fragile material, then it may break. If it is made from a material that melts when heated, then it melts with time, diffusing the chemicals. Subsequently, the weight 104 is moved down the hole, as shown in FIG. 9B. The weight 104 then collides with the capsule 101 from behind. This certainly destroys the bottom plate 103 made from a fragile material. Also, the magnet 105 magnetically attracts the capsule 101, so that both are coupled together, as shown in FIG. 9C. Finally, the wire 106 is drawn upward to recover the capsule 101, as shown in FIG. 9D.

The chemicals are allowed to spread while the drilling rod is not pulled away. Therefore, if the chemicals react with the slime at the bottom of the hole and solidify, then rotation of the rig may be hindered. In order to circumvent this undesirable situation, the rod is raised to a certain height before the capsule is lowered. The chemicals are enabled to spread at the certain height above the bottom. The chemicals drop as a mass to the location of lost circulation and solidify, but no problems take place in restarting the rig of the rod. The capsule constructed as mentioned thus far yields the following advantages.

(1) Since it is not necessary to pull up or lower the drilling rod, the time required for the execution of work is short.

(2) Since it is not necessary to pull up the drilling rod, it is possible to let down the capsule immediately after the occurrence of lost circulation, for stopping the flow of water. Consequently, only a small amount of drilling mud is necessitated to stabilize porous sidewalls.

(3) Since the capsule is guided along the drilling rod, the capsule can be certainly conveyed to a desired depth where lost circulation takes place.

(4) Depending on the condition of lost circulation, several capsules may be let down to stop the flow of issuing water.

(5) The capsule can be handled easily because of its shape and because the bottom plate is replaceable.

(6) Since only the broken bottom plate is replaced with another, the cost is low.

Figure 10:
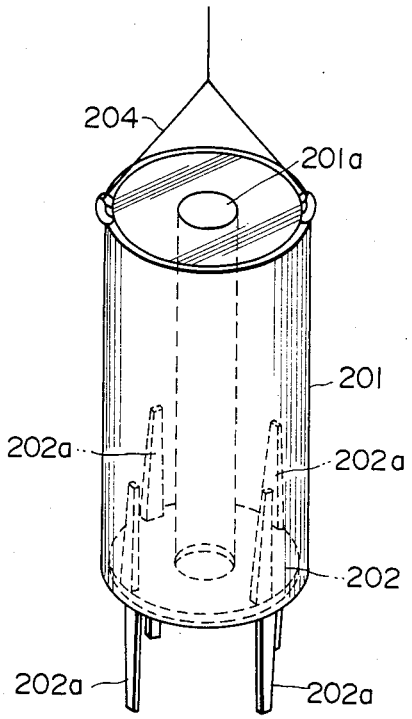
FIG. 10 is a perspective view of a still other capsule according to the invention.

Referring next to FIG. 10, there is shown a still other capsule according to the invention. The capsule, indicated by numeral 201, contains chemicals for stopping lost circulation. This capsule 201 is annular in cross section and centrally provided with a hole 201*a* in which a drilling rod is loosely inserted. Thus, the capsule 201 is mounted on the rod so as to embrace the rod. In the illustrated example, the capsule is totally molded out of a material. The capsule is mounted on the rod at its one end. Where it is desired to mount the capsule at an intermediate position on the rod, the capsule may be divided vertically into two sections which are coupled together with a pin. The capsule 201 is guided along the rod and thus moves down the hole smoothly until it strikes on a rig.

Figure 11:
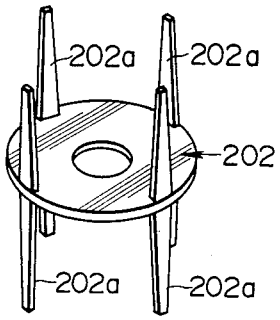
FIG. 11 is a perspective view of the bottom plate of the capsule shown in FIG. 10.
Figure 12:
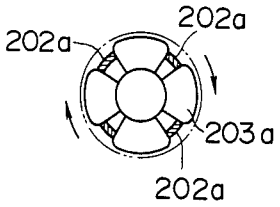
FIG. 12 is a view for illustrating the manner in which the bottom plate shown in FIG. 11 is destroyed.

The capsule 201 is made of paper except for its bottom plate 202, which is made from a fragile material such as glass or ceramic. As shown in FIG. 11, vertically extending protrusions 202*a* are formed integrally with the bottom plate 202 and circumferentially disposed on the top and bottom surfaces of the plate 202. The upwardly extending protrusions 202*a* act as legs that allow the bottom plate 202 to be fitted into the capsule 201 with certainty. As shown in FIG. 12, the downwardly extending protrusions 202*a* are forced between the neighboring knife edges of a rig 203*a*. As the rig 203*a* is rotated, the protrusions destroy the checkerboard-like plate.

Before the bottom plate 202 is mounted, chemicals are introduced into the capsule 201. Then, the bottom plate 202 is mounted to close up the capsule. It is also possible to form an opening in the top cover of the capsule to permit chemicals to enter it. A wire 204 is used to suspend the capsule when the velocity of the descending capsule is controlled.

Chemicals are conveyed through a drilled hole 205 along a drilling rod 203 by the capsule 201 in the manner described below. In the illustrated example, chemicals are diffused while the rod 203 is not withdrawn. Therefore, there arises the possibility that the chemicals react with slime at the bottom of the hole and solidify, hindering rotation of the rig 203*a*. This situation can be avoided in the manner described below.

Figures 13A, 13B, 13C, 13D:
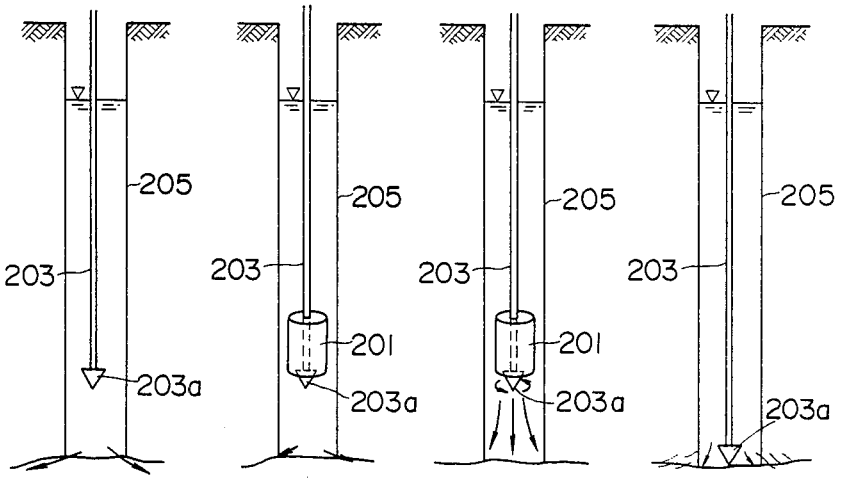
FIGS. 13A–13D are views for showing the manner in which the capsule shown in FIG. 10 is used.

When lost circulation occurs, the drilling rod 203 is brought to a stop. Then, the rod is upwardly moved a certain distance of 10 to 20 m, as shown in FIG. 13A. The capsule 201 is mounted on the rod 203 and let down until it collides with the rig 203*a* and comes to a halt, as shown in FIG. 13B. The rod 203 is then rotated, causing the rig 203*a* to destroy the bottom plate 202. Thus, the chemicals are diffused. Subsequently, the rig 203*a* is turned slowly to prevent adhesion of the diffused chemicals and to break the swollen capsule 201, as shown in FIG. 13C. The chemicals are scattered at a certain level above the hole bottom, drop toward the location of lost circulation as a mass, and solidify. However, no problems arise in restarting the rig of the rod. The pieces of the broken plate are sucked into the place of lost circulation. As a result, the sucking hole is plugged up. After checking the stoppage of the flow of water, the drilling work is restarted (FIG. 13D).

The capsule constructed as described above yields the following advantages.

(1) Since it is not necessary to pull up or lower the drilling rod, the time required for the execution of work is short.

(2) Since it is not necessary to pull up the drilling rod, it is possible to let down the capsule immediately after the occurrence of lost circulation, for stopping the flow of water. Consequently, only a small amount of drilling mud is necessitated to stabilize porous sidewalls.

(3) Since the capsule is guided along the drilling rod, the capsule can be certainly conveyed to a desired depth where lost circulation takes place.

(4) Depending on the condition of lost circulation, several capsules may be let down to stop the flow of issuing water.

(5) Since the capsule 1 is a throwaway capsule, specialist's help is not needed. Hence, the capsule can be handled easily.

(6) Since the body of the capsule made of a paper tube breaks into pieces, the capsule is effective in filling up fissures.

What is claimed is:

1. A method of conveying chemicals through a borehole, comprising the steps of:

preparing a capsule at least partially comprising a fragile material;

charging the capsule with chemicals for stopping lost circulation in the borehole; and lowering the capsule toward the location of the lost circulation so that at least a portion of said capsule is destroyable by a drilling rod placed in the borehole, the drilling rod acting also as a means for halting lowering of said capsule, the rod having a means at a front end thereof for opening the capsule, whereby the chemicals are diffused.

2. A method of conveying chemicals through a borehole, comprising the steps of:

preparing a capsule made from a resin such as glass fiber-reinforced plastic, the capsule containing chemicals for stopping lost circulation, the capsule having an annular upper end surface and magnets disposed circumferentially on the upper end surface, the capsule having a bottom plate made from a destroyable material, the capsule being mounted on a drilling rod so as to embrace the rod;

lowering the capsule along the rod until the capsule strikes on a rig;

lowering an annular weight along the drilling rod, the weight being suspended by a wire, the weight having means disposed thereon for magnetic attachment to said magnets pushing said capsule bottom plate against the ring by said weight for destruction of said bottom plate and diffusion of the chemicals; and pulling up the weight, to which the capsule has been magnetically attached, for recovering the capsule.

3. A system for conveying chemicals through a borehole, comprising:

a capsule mountable on a drilling rod so as to embrace the rod, the capsule being annular in cross section, the capsule having a bottom plate made from a destroyable material, the capsule having magnets embedded in its upper surface and disposed circumferentially, the capsule being charged with chemicals for stopping borehole lost circulation; and a weight mountable on the drilling rod so as to embrace the rod in the same manner as the capsule, the weight being annular in cross section, the weight being made from a magnetically permeable material, the weight being suspended by a wire, the weight acting to destroy the bottom plate of the capsule and also to recover the capsule via magnetic attachment thereto.

4. A method of conveying chemicals through a borehole, comprising the steps of:

preparing a capsule made of paper, the capsule being charged with chemicals for stopping lost circulation, the capsule being annular in cross section, the capsule having a plate made from a fragile material such as glass or ceramic, the plate being mounted on or into the body of the capsule with a press fit, the plate having vertically extending protrusions around its periphery;

mounting the capsule on a drilling rod so as to embrace the rod;

letting down the capsule along the rod;

then rotating a rig engaging with the protrusions to rotate the protrusions, for destroying the bottom plate, resulting in the chemicals to diffuse; and continuing to rotate the rig to prevent the diffusing chemicals from adhering to the rig and also to destroy the capsule.

5. A capsule for conveying chemicals through a borehole, comprising a capsule which is made from paper and can be mounted on a drilling rod so as to embrace the rod, the capsule being annular in cross section, the capsule having a plate at its bottom, the plate being mounted on or into the body of the capsule with a press fit, the plate being made from a fragile material such as glass or ceramic, the plate having vertically extending protrusions around its fringe, the capsule being charged with chemicals for stopping lost circulation.

6. A method of conveying chemicals through a borehole, comprising the steps of:

providing a capsule for said chemicals, said capsule at least partially comprising a thermoplastic material which softens at a specified temperature and pressure such that said chemicals are diffusible into the borehole;

lowering the capsule along a drilling rod and into the borehole toward a location of lost circulation;

halting said capsule lowering, by a portion of said drill rod, at a depth of said borehole wherein envioronmental temperature and pressure are sufficient to soften said thermoplastic material for diffusion of the chemicals.

* * * * *